US005382761A

United States Patent [19]

Amano

[11] Patent Number: 5,382,761

[45] Date of Patent: Jan. 17, 1995

[54] ELEVATOR GROUP CONTROL DEVICE

[75] Inventor: Masaaki Amano, Inazawa, Japan

[73] Assignee: Mitsubishi Denki Kabushiki Kaisha, Tokyo, Japan

[21] Appl. No.: 10,365

[22] Filed: Jan. 28, 1993

[30] Foreign Application Priority Data

Jan. 30, 1992 [JP] Japan ..... 4-038410

[51] Int. Cl.[6] ..... B66B 1/18

[52] U.S. Cl. ..... 187/383

[58] Field of Search ..... 187/127, 128, 124; 137/130, 139

[56] References Cited

U.S. PATENT DOCUMENTS

| | | | |
|---|---|---|---|
| 3,831,715 | 8/1974 | Matsuzawa et al. | 187/29 R |
| 4,691,808 | 7/1987 | Nowak et al. | 187/125 |
| 4,735,294 | 4/1988 | Schroder | 187/121 |
| 4,846,311 | 7/1989 | Thangavelu | 187/125 |
| 4,915,197 | 4/1990 | Schroder | 187/121 |
| 5,054,585 | 10/1991 | Amano | 187/124 |
| 5,252,790 | 10/1993 | Aime | 187/127 |

FOREIGN PATENT DOCUMENTS

| | | |
|---|---|---|
| 0450766 | 10/1991 | European Pat. Off. . |
| 0452225 | 10/1991 | European Pat. Off. . |
| 53-40843 | 10/1978 | Japan . |
| 21064 | 1/1990 | Japan . |

*Primary Examiner*—Steven L. Stephan
*Assistant Examiner*—Robert Nappi
*Attorney, Agent, or Firm*—Leydi, Voit & Mayer

[57] ABSTRACT

An elevator group control device includes a call allotment judgment means 5A which allots the cages to a newly registered destination floor selected by a passenger pushing a destination button upon a destination button board 1. The call allotment judgment means 5A first determines whether or not there exist a cage with a service schedule including the destination floor. If the judgment is affirmative, the destination floor is allotted to the cage. If not, it is judged whether or not there exist cages with a service schedule extending to a floor within a predetermined range above or below said destination floor. If there are a plurality of cages, the cage with a narrower service schedule is selected. If there exist only one cage, such cage is selected. Then, the service schedule of the selected cage is extended to include the destination floor. If there is no cage with the above requirement, a cage hitherto without a service schedule is selected and a new service schedule is created therefor.

4 Claims, 10 Drawing Sheets

ELEVATOR GROUP CONTROL DEVICE

BACKGROUND OF THE INVENTION

This invention relates to elevator group control devices for elevator apparatus installed in buildings by which the landing floors of the elevator cages are provided with the destination buttons and the service schedule displays for indicating the floors serviced by respective cages.

With recent introduction of microcomputers, the group control devices for controlling a plurality of elevator cages are now capable of processing a large amount of information and thus accomplishing a sophisticated scheduling control of the elevator cages.

This is especially true for the elevator group control devices installed in buildings accommodating a large number of offices where a plurality of elevator cages are operated. In such buildings, there are certain time zones in which the elevators are particularly crowded with passengers. These crowded time zones generally include the morning and evening hours when the commuters get to and return from their offices, and the lunch time when people go out of their offices to have lunch. During these crowded time zones, the scheduling of the elevator cages are modified and adapted to the particular crowded pattern (for example, a plurality of cages are allotted to the crowded floor and stopped there to wait for passengers with doors open), such that the passengers concentrated at the crowded floor may be conveyed to their destination effectively.

For example, during the morning time when the commuters get on the elevator to get to their offices, the embarking call for the ground floor (referred to as the main floor) is registered permanently in the elevator group control device such that a plurality of cages are set waiting with their doors open at the main floor for the incoming passengers. Further, in the case where the elevators are extremely crowded with commuters, the control method known as the divided service scheduling for commuters may be adopted. That is, the floors of the building, except for the main floor, serviced by the elevators are divided into two zones, the upper floors zone and the lower floors zones (see FIG. 10). The two zones are served by distinct sets of elevator cages such that the incoming passengers concentrated at the main floor can be conveyed to their respective destination by means of the cages dedicated to their destinations. The crowded passengers are thus conveyed effectively.

The above divided service scheduling for commuter passengers, however, has the floor disadvantage. Each cage is scheduled either for the upper floors zone or the lower floors zone. Thus the passengers should select by themselves an elevator cage scheduled for their destination and push the destination button associated with the cage. This is a burden upon the passengers. Further, since all the cages are returned to the main floor even when there is no real need, the service efficiency of the cages may be substantially less than optimal.

SUMMARY OF THE INVENTION

It is therefore an object of this invention to provide an elevator group control device by which flexible and efficient scheduling of the elevator cages can be offered particularly in crowded time zones such as when a large number of commuters come in and go out of their respective offices of the building in which the elevator apparatus is installed.

The above object is accomplished in accordance with the principle of this invention by an elevator group control device for controlling a plurality of elevator cages installed in a building, on at least one floor of which are provided destination button means for selecting a destination floor and service schedule display means for displaying service schedules indicative of floors that can be served by respective elevator cages. The elevator group control device includes:

destination floor registration means for registering a destination floor in response to a selection of the destination floor by a passenger by means of the destination button means; and call allotment judgment means for determining a cage allotted to a destination floor registered by the destination floor registration means, wherein:

(a) the call allotment judgment means judges whether or not there exist a cage with a service schedule extending to a floor within a predetermined range above or below the destination floor;

(b) if the judgment is affirmative at (a), the call allotment judgment means extends the service schedule of the cage to include the destination floor;

(c) if the judgment is negative at (a), the call allotment judgment means selects a cage hitherto without a service schedule and allots the destination floor to the selected cage, creating a new service schedule including the destination floor for the selected cage; and (d) the call allotment judgment means transmits information upon the service schedule of the cage to the service schedule display means such that the the service schedule of the cage is displayed immediately by the service schedule display means.

Preferably, the device further includes learning means for determining and registering crowded floors on the basis of periodically obtained statistics of load data of respective cages for each floor. Then, (a) the call allotment judgment means judges whether or not there exist a cage with a service schedule extending to a floor within a predetermined range above or below the destination floor;

(b) if the judgment is affirmative at (a), the call allotment judgment means determines whether or not the service schedule extending to a floor within the predetermined range above or below the destination includes at least one of the crowded floors;

(c) if the judgment is negative at (b), the call allotment judgment means extends the service schedule of the cage to include the destination floor;

(d) if the judgment is negative at (a), the call allotment judgment means selects a cage hitherto without a service schedule and allots the destination floor to the selected cage, creating a new service schedule including the destination floor for the selected cage, the new service schedule consisting of floors situated within a second predetermined number of stories above or below the destination floor;

(e) if the judgment is affirmative at (b), the call allotment judgment means selects a cage hitherto without a service schedule and allots the destination floor to the selected cage, creating a new service schedule including the destination floor for the selected cage, the new service schedule consisting of floors situated within a third predetermined number of stories above or below the destination floor, the third predetermined number being less than the second predetermined number; and (f) the call allotment judgment, means transmits information upon the service schedule of the cage to the service schedule display means such that the the service schedule of the cage is displayed immediately by the service schedule display means.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

In the drawings, like reference numerals represent like or corresponding parts or portions.

DETAILED DESCRIPTION OF THE PREFERRED EMBODIMENTS

Referring now to the accompanying drawing, the preferred embodiments of this invention are described. First, the first embodiment is described by reference to FIGS. 1 through 5.

Figure 1:
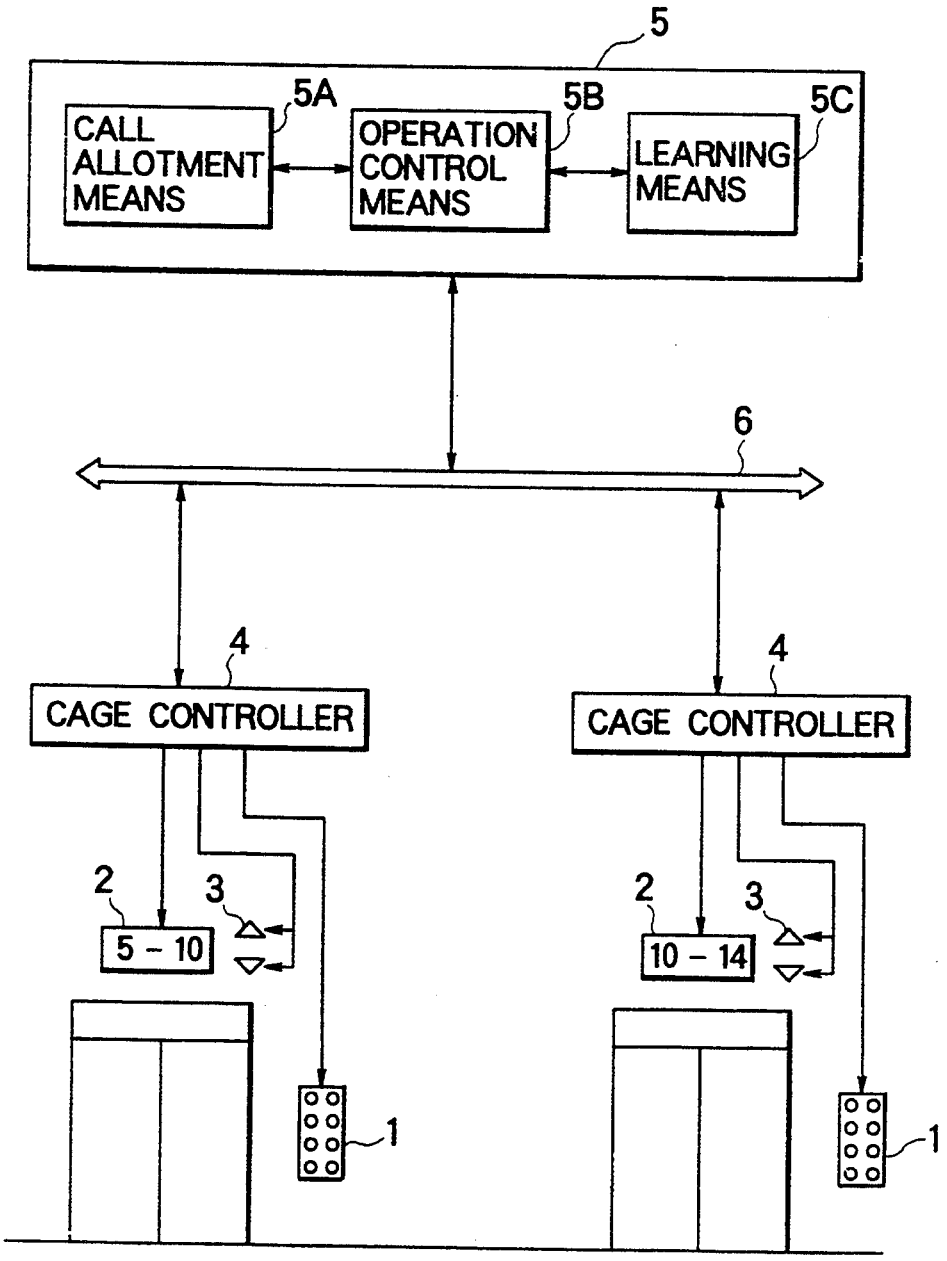
FIG. 1 is a block diagram showing the overall structure of the elevator group control device according to this invention.

FIG. 1 is a block diagram showing the overall structure of the elevator group control device according to this invention. A destination button board 1 with a plurality of destination buttons is provided for each elevator cage at each landing floor. The passengers push a destination button upon the destination button board 1 to register their destinations. When a passenger pushes a destination button upon the destination button board 1, the call for the destination floor indicated by the destination button is registered in the group controller 5. The details thereof are disclosed, for example, in Japanese Laid-Open Patent (Kokai) No. 1-267278. A service schedule display board 2 consisting of a dot-matrix type light-emitting diode digital display is set over the doors at each landing floor of each elevator. The service schedule display board 2 displays the service schedule of the elevator cage (the floors served by the cage). A hall lantern 3, consisting of upward-bound and downward-bound cage arrival indicators, is provided for each cage to indicate the forecasted or actual arrival of the upward and downward-bound cage. (Upon the bottom floor served by the elevator, each hall lantern 3 consists solely of an upward-bound arrival indicator. Similarly, upon the top floor served by the elevator, each hall lantern 3 consists only of an downward-bound arrival indicator.) An individual cage controller 4 provided for each elevator cage controls the operation thereof.

A group controller 5 controls the overall operation of the elevator apparatus which includes a plurality of elevator cages operated within respective shafts. The group controller 5 includes a call allotment judgment means 5A, a cage operation control means 5B, and a learning means 5C. The call allotment judgment means 5A determines a cage which should serve the floor newly registered by a passenger pushing a destination button upon a destination button board 1. Further, the call allotment judgment means 5A transmits the service schedule information of each cage (the floors served by each cage) to the service schedule display board 2 of the cage at each floor. The cage operation control means 5B effects overall control of the operations of the cages. The learning means 5C periodically effects statistical processing of data such as the operation and service conditions of respective cages. The communication between the individual cage controller 4 and the group controller 5 is effected via a system bus 6.

Next the operation of the first embodiment, especially the operation during the crowded time zones such as the commuter arrival or departure hours, is described.

Figure 2:
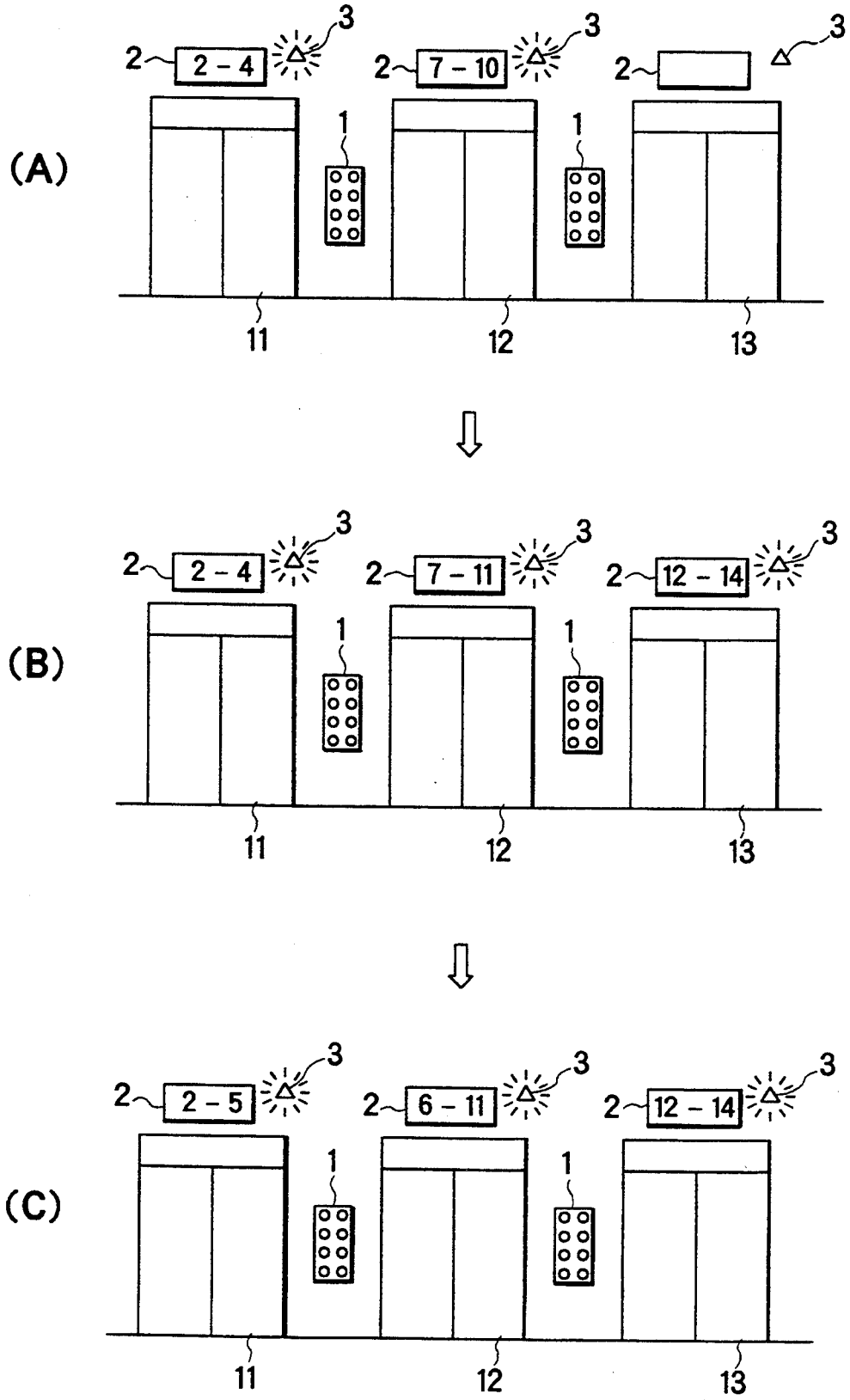
FIG. 2 shows front views of the elevators at the main floor of the building.

FIG. 2 shows front views of the elevators at the main floor of the building. It is assumed that a building including first through fourteenth floors is served by three elevator cages operated in respective shafts. The first is also the bottom floor served by the elevator. The first floor is the main floor. Each service schedule display board 2 displays the service schedule of the associated cage (namely, the service schedule display board 2 displays the floors served by the cage). For example, if the floors served by a cage is determined by the call allotment judgment means 5A to be 7th through 10th floor, the service schedule display board 2 associated with the cage displays instantly the service schedule information in the form of characters: "7–10".

For example, first at (A) in FIG. 2, it is assumed that destination buttons for the 2nd and 10th floor are pushed by passengers at the main floor. The call information (i.e., the information that the 2nd and 10th floor are called from the main floor) is transmitted to the group controller 5 via the system bus 6, and is registered therein. The call allotment judgment means 5A then determines the cages allotted to the respective calls. It is assumed that the first cage is allotted to the call to the 2nd floor, and the second cage is allotted to the call to the 10th floor. Further, the call allotment judgment means 5A determines a predetermined range of floors, including the registered destination floor, for each cage to which a destination floor has been allotted. The predetermined range thus determined constitutes the floors scheduled to be served by cage. As described in detail below, if a destination button for a new floor within the service schedule range of a cage is pushed by a passenger, such floor is served by the cage with the service schedule range including the newly registered floor.

The service schedule display board 2 displays the range or service schedule thus determined for each cage. Here, it is assumed that the call allotment judgment means 5A determines the 2nd through 4th floor and the 7th through 10th floor for the first elevator 11 and the second elevator 12, respectively. Thus, the service schedule display board 2 of the first elevator 11 displays that the cage is scheduled to serve the second through fourth floor. Similarly, the service schedule display board 2 of the second elevator 12 displays that the cage is scheduled to serve the seventh through tenth floor. The third cage is not allotted to any call and hence has no service schedule at present. Thus the service schedule display board 2 thereof displays no characters.

At (B) in FIG. 2, it is assumed that newly arriving passengers push the destination buttons for the 3rd, 11th and 14th floor. The newly registered 3rd floor is already served by the first cage (i.e., the 3rd floor is within the service schedule of the first elevator 11 as displayed on the service schedule display board 2 thereof). Thus, the 3rd floor is allotted to the first cage, and the characters displayed on the service schedule display board 2 thereof: "2–4" do not change. The newly registered 11th floor is just above the range (7th through 10th floor) served by the second cage. Thus, the service schedule of the second elevator 12 is extended to the 11th floor, and the service schedule display board 2 thereof changes accordingly to "7–11". The newly registered 14th floor is not within or adjacent to the service schedule of any cage. Thus 14th floor is allotted to the third cage. The service schedule including the registered 14th floor: "12–14" is displayed on the service schedule display board 2 of the third elevator 13.

Further at (C) in FIG. 2, it is assumed that newly arriving passengers push the destination buttons for the 5th, the 6th, and the 13th floor. The newly registered 5th floor is just above the service schedule (2nd through 4th floor) of the first cage. Thus, the 5th floor is allotted to the first cage, and the service schedule of the first elevator 11 is extended to the 5th floor. Accordingly the service schedule display board 2 changes its display to: "2–5". On the other hand, the newly registered 6th floor is just below the service schedule (7th through 11th floor) of the second cage. Thus, the 6th floor is allotted to the second elevator 12, and the service schedule thereof is extended to the 6th floor. Accordingly the service schedule display board 2 thereof changes its display to: "6–11". The newly registered 13th floor is already served by the third cage (i.e., within the service schedule of the third cage as displayed on the service schedule display board 2 thereof). Thus, the 13th floor is allotted to the third cage, and the characters "12–14" displayed on the service schedule display board 2 of the third elevator 13 do not change.

As described above, each time a destination button upon a destination button board 1 is pushed by an incoming passenger, the call information is transmitted to the group controller 8, and a cage for serving the newly registered destination floor is determined instantly by the call allotment judgment means 5A. If the new destination floor is within the service schedule of an already operating cage, the new floor is allotted to such cage. Otherwise, the service schedule of an operating cage is extended to include the new destination floor, or a hitherto halting cage is allotted to the new destination floor. Under such circumstances, a newly created service schedule range including the new destination floor is served by the cage. The service schedules of currently operated cages are displayed on the respective service schedule display board 2. Thus, each passenger may wait for the arrival of the cage at the appropriate elevator 11, 12, or 13 the service schedule display board 2 of which displays the range of floors including his or her destination.

Figure 3:
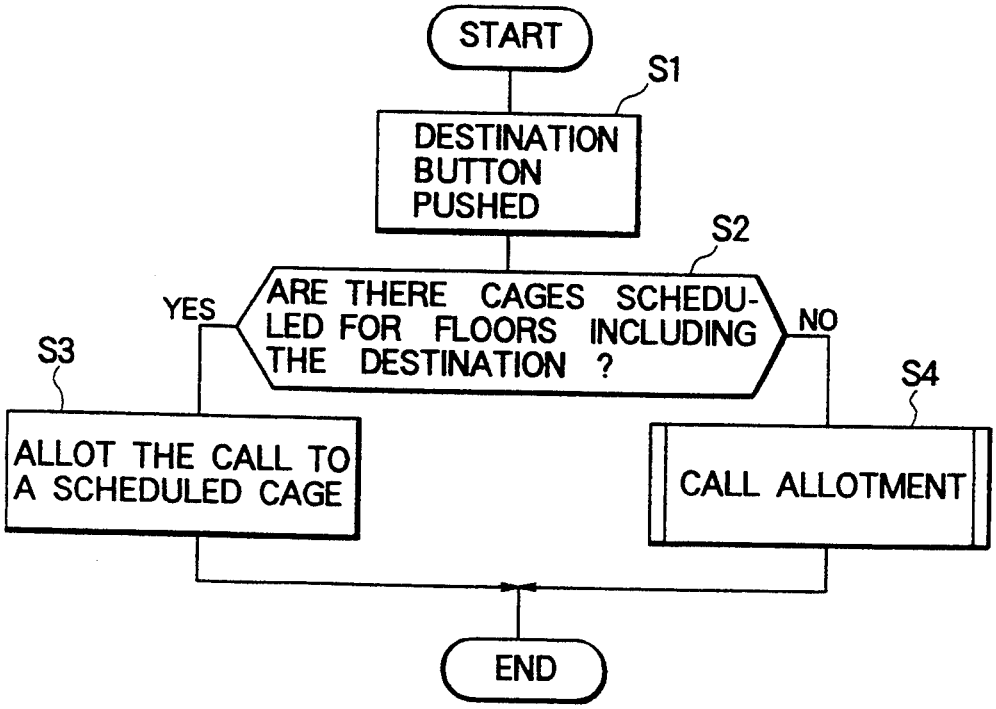
FIG. 3 is a flowchart showing the cage allotment procedure by which the cage allotted for a destination is determined according to this invention.

FIG. 3 is a flowchart showing the cage allotment procedure by which the cage allotted for a destination is determined according to this invention. The procedure is executed by the call allotment judgment means 5A of group controller 5.

At step S1, when a destination button is pushed by a passenger upon a destination button board 1 upon the main floor, the information is transmitted to the group controller 5 via the system bus 6 and registered in the group controller 5. At step S2, it is judged whether or not there already exist a cage with a service schedule including the newly registered floor. Namely, the call allotment judgment means 5A judges whether or not there exists a cage with a service schedule including the newly registered destination floor, which service schedule is displayed upon the service schedule display board 2 over the elevator doors on the main floor. If the judgment is affirmative at step S2, the execution proceeds to step S3, where the cage with the service schedule including the newly registered destination floor is allotted to the newly registered destination floor. If the judgment is negative at step S2, the execution proceeds to step S4, where a call allotment judgment procedure, as described in detail below by reference to FIGS. 4*a*, 4*b*, and 5, is effected.

Figure 4A:
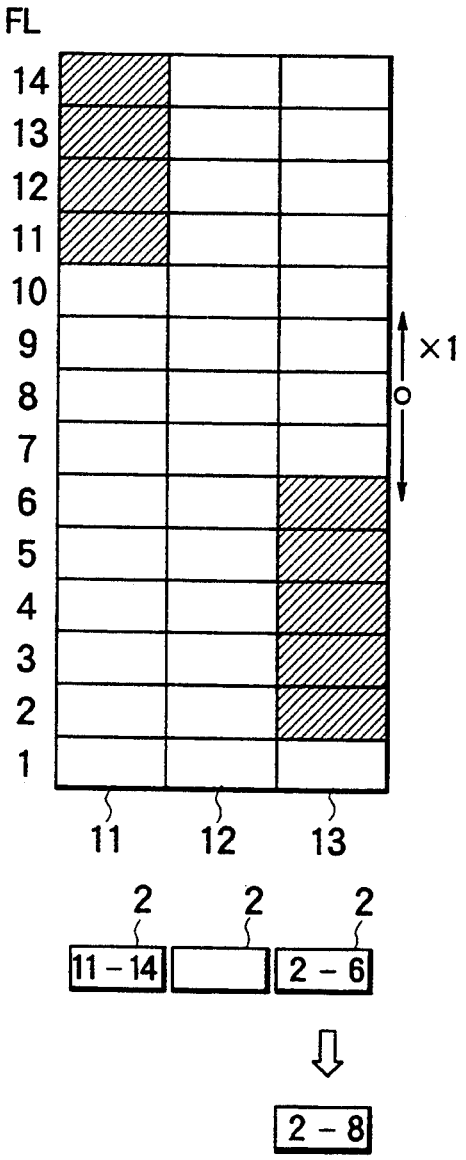
FIG. 4*a* is a diagram illustrating the service schedule modification and creation procedure according to the first embodiment of the invention.

FIG. 4*a* is a diagram illustrating the service schedule modification and creation procedure according to the first embodiment of the invention. FIG. 4*b* is a diagram similar to FIG. 4*a*, illustrating the procedure as applied to another case. In FIG. 4*a*, the service schedule display board 2 of the first elevator 11 displays the service schedule "11–14", and that of the third elevator 13 the service schedule "2–6". The service schedule or the floor ranges served by respective cages of the first elevator 11 and the third elevator 13 are shown as hatched regions. The second elevator 12 is without any service schedule. Under this circumstance, it is assumed that a destination button for the 8th floor upon a destination button board 1 on the main floor is pushed by a passenger and is registered. Then the call allotment judgment means 5A first determines the range X1 consisting of floors situated within two stories above or below the newly registered floor. In this case, the range X1 extends from the 6th floor (two stories below the newly registered 8th floor) to the 10th floor (two stories above the newly registered 8th floor). The call allotment judgment means 5A further judges whether or not the range X1 overlaps with the service schedule of any one of the cages in operation. Under the circumstance, the range X1, extending from the 6th to 10th floor, overlaps with the service schedule of the third elevator 13 extending from the 2nd to the 6th floor. Namely, the 6th floor is common to both the range X1 and the service schedule of the third elevator 13. Thus, the newly registered 8th floor is allotted to the third elevator 13, and the service schedule thereof is extended to the 8th floor. The new service schedule "2–8" of the third elevator 13 is immediately displayed on the service schedule display board 2 thereof.

Figure 4B:
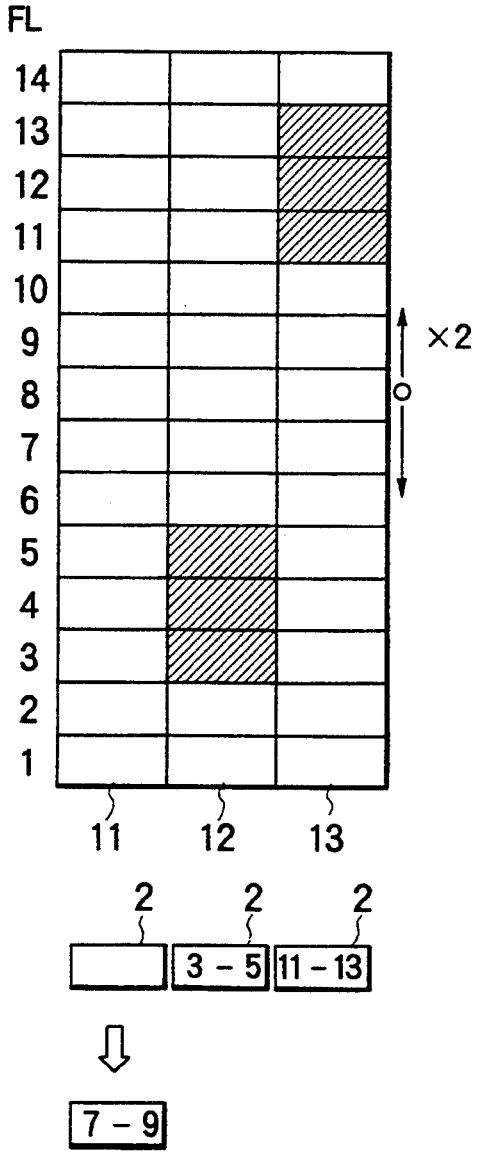
FIG. 4*b* is a diagram similar to FIG. 4*a*, illustrating the procedure as applied to another case.

In FIG. 4*b*, on the other hand, the service schedule display board 2 of the second elevator 12 displays the service schedule "3–5", and that of the third elevator 13 the service schedule "11–13". The first elevator 11 is not in operation at present and thus is without any service schedule. Hence the service schedule display board 2 thereof displays no characters. The service schedule ranges of the second elevator 12 and the third elevator 13 are shown as hatched regions. It is assumed here that a destination button for the 8th floor upon a destination button board 1 is pushed by a passenger and is registered. Then the call allotment judgment means 5A first determines the range X2 consisting of floors situated within two stories above or below the newly registered floor. In this case, the range X2 is from the 6th floor (two stories below the newly registered 8th floor) to the 10th floor (two stories above the newly registered 8th floor). The call allotment judgment means 5A further judges whether or not the range X2 overlaps with the service schedule of any one of the operated cages. Under the circumstance, the range X2, extending from the 6th to 10th floor, exhibits no overlap with any of one of the service schedules of the cages in operation. Thus, the newly registered 8th floor is allotted to the first elevator 11 which has hitherto not been allotted to any destination floor and no service schedule exist therefor. Further, the service schedule range "7–9" including the newly registered 8th floor is created for the first elevator 11 and is immediately displayed on the service schedule display board 2 thereof. In this case, the new service schedule consists of the newly registered floor plus the floors just above and below it.

Figure 5:
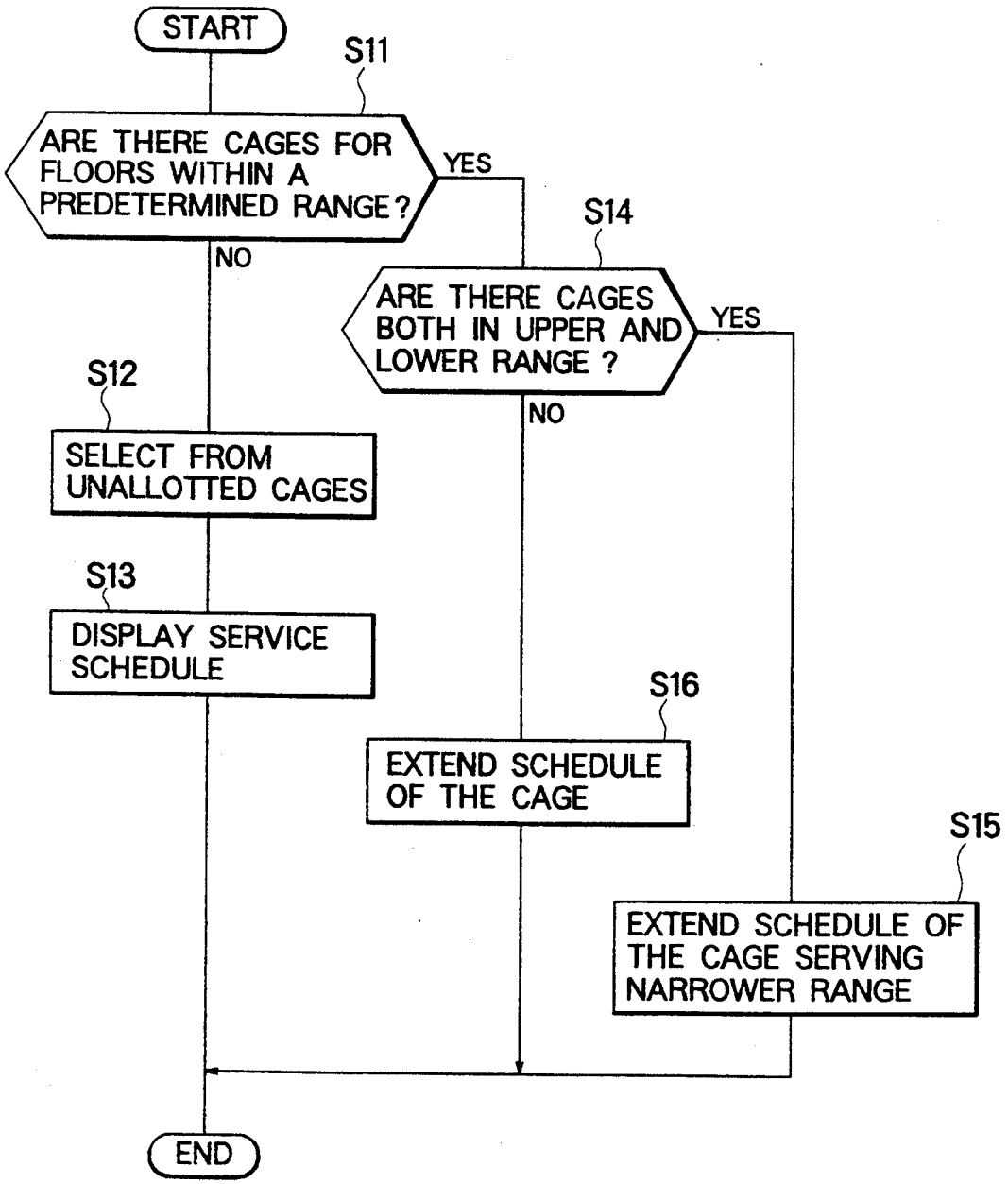
FIG. 5 is a flowchart showing the service schedule modification and creation procedure according to the first embodiment of this invention.
Figure 6A:
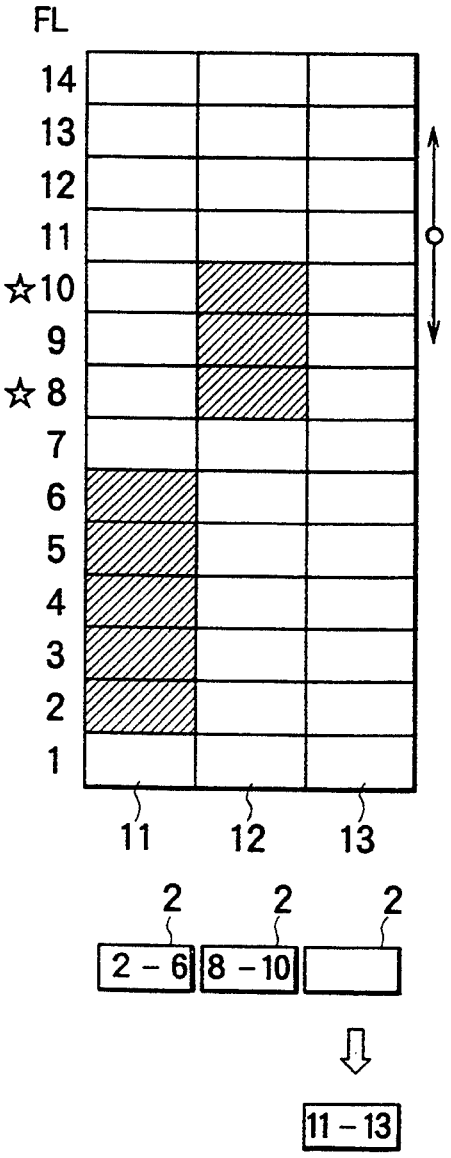
FIG. 6*a* is a diagram illustrating the service schedule modification and creation procedure according to the second embodiment of the invention.
Figure 6B:
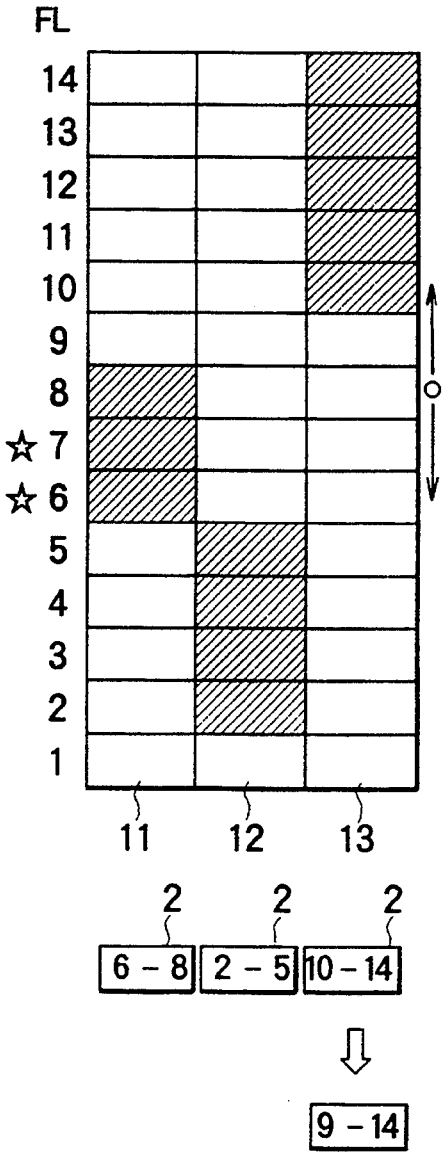
FIG. 6*b* is a diagram similar to FIG. 6*a*, illustrating the procedure as applied to another case.

FIG. 5 is a flowchart showing the service schedule modification and creation procedure according to the first embodiment of this invention. When a passenger pushes a destination button upon a destination button board 1 situated on the main floor, the call allotment judgment means 5A determines the cage allotted to the newly registered floor.

At step S11, it is judged whether or not there exist cages with the service schedule extending to floors within a predetermined range above or below the newly registered destination floor. Namely, the call allotment judgment means 5A first determines the range X consisting of floors within a predetermined number of stories (e.g., two stories) above or below the newly registered floor. Next, the call allotment judgment means 5A judges whether or not the range X has an overlap with any one of the service schedules of the cages in operation.

If the judgment is negative at step S11, the execution proceeds to step S12, where an unallotted cage is selected. Namely, a cage which has not been put in operation yet and hence is not provided with any service schedule is selected. After step S12, the execution proceeds to step S13 where a new service schedule for the cage selected at step S12 is created and displayed on the service schedule display board 2 thereof. The new service schedule including the newly registered floor consists of floors situated within a predetermined range above or below the newly registered floor.

If the judgment is affirmative at step S11, the execution proceeds to step S14 where it is judged whether or not there exist cages with service schedules both within predetermined number of stories above and below the newly registered destination floor. For example, assume that the newly registered floor is the 8th floor and the range X consists of floors situated within two stories above or below the 8th floor. Then, the range X extends from the 6th to 10th floor. It is noted that the procedure of FIG. 5 is called only if the judgment at step S2 in the procedure of FIG. 3 is negative. Thus, during execution of the procedure of FIG. 5, the newly registered 8th floor is not within any one of the existing service schedules. Further, when the execution has proceeded to step S14, it has already been determined at step S11 that the range X overlaps with at least one of the existing service schedules. Thus at step S14, the call allotment judgment means 5A judges whether both the upper half of the range X, namely, the 9th and the 10th floors, and the lower half of the range X, namely, the 6th and the 7th floors, exhibit an overlap with one of the existing service schedules. In effect, the call allotment judgment means 5A determines at step S14 whether or not there exist a plurality of cages with respective service schedules overlapping with the range X.

If the judgment is affirmative at step S14, the execution proceeds to step S15 where the ranges of the service schedules (i.e., the numbers of floors constituting the respective service schedules) exhibiting overlaps with the range X as determined at step S11 are compared, and the cage with the narrower service schedule (i.e., the service schedule consisting of a smaller number of floors) is selected, and the newly registered floor is allotted thereto. If the number of cages is more than three, there may exist more than two cages with service schedules overlapping with the range X. Then, the cage with the service schedule consisting of smallest number of floors is selected. After a cage is thus selected, the service schedule of the selected cage is extended to the newly registered destination floor. The extended service schedule of the cage is immediately displayed on the service schedule display board 2 of the cage.

On the other hand, if the judgment is negative at step S14, the execution proceeds to step S16, where the service schedule of the cage overlapping with the range X is extended and displayed. A negative judgment at step S14 implies that there is only one cage with a service schedule overlapping with the range X. Thus, the newly registered floor is allotted to this cage. The service schedule of the cage is extended to include the newly registered floor, and the extended service schedule thereof is displayed upon the service schedule display board 2 thereof.

Figure 10:
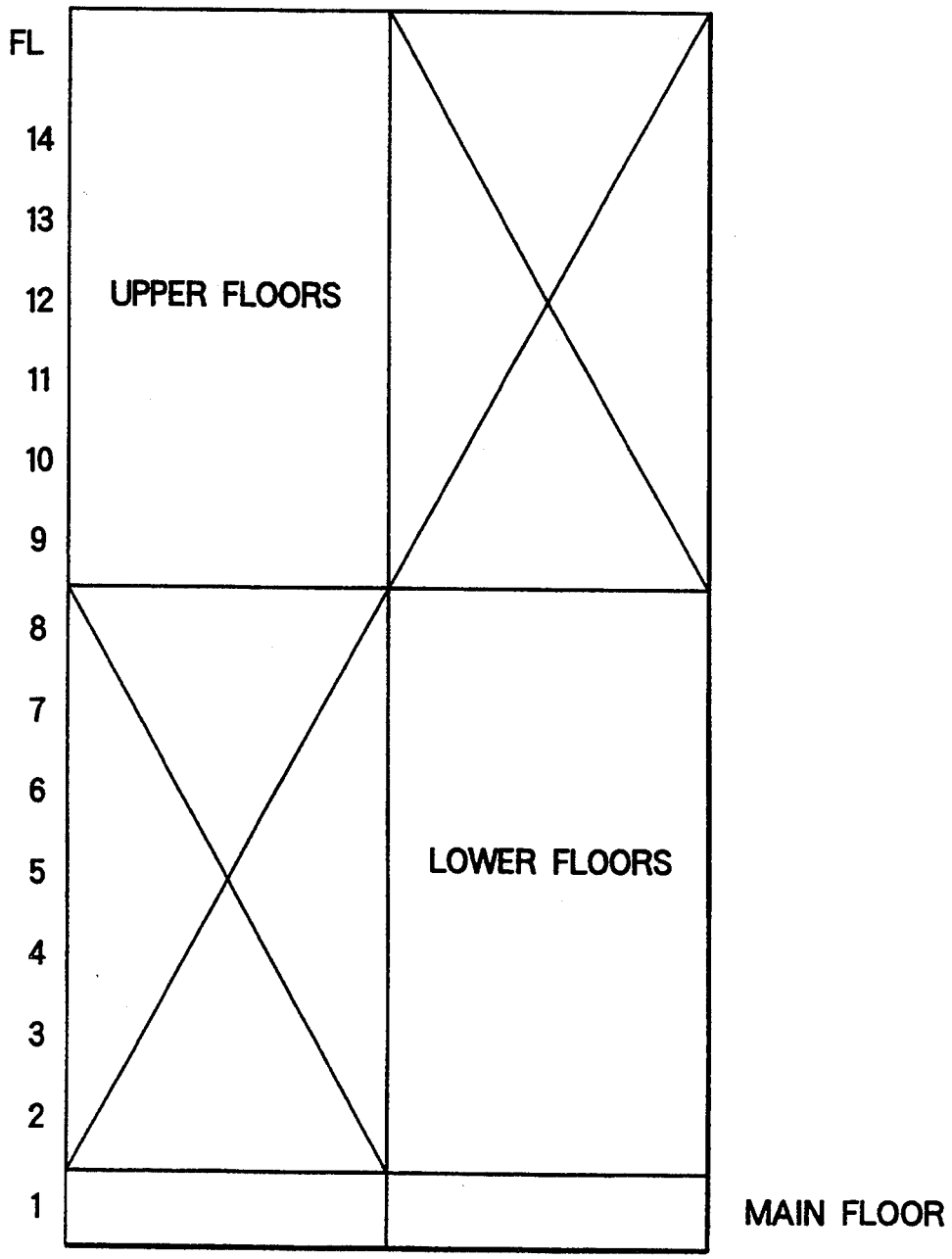
FIG. 10 (PRIOR ART)
FIG. 10 is a block diagram showing the conventional divided service scheduling for commuters.

As described above, according to the procedure of FIG. 5, the passengers may select any floor served by the elevators by pushing a destination button upon a destination button board 1 of the elevators. In response to the registering of a destination floor by a passenger, a cage with a service schedule extending to a floor situated within a predetermined number of stories above or below the newly registered destination floor is automatically selected, and the service schedule of the selected cage is extended to include the newly registered destination floor. Thus, compared to the conventional divided service scheduling for commuter passengers (see FIG. 10), the grouping or division of the serviced floors among the elevator cages is rendered more flexible, and a more efficient scheduling of the cages is realized.

Next, the second embodiment is described by reference to FIGS. 1 through 3 and 6 through 9. FIG. *6a* is a diagram illustrating the service schedule modification and creation procedure according to the second embodiment of the invention. FIG. *6b* is a diagram similar to FIG. *6a*, illustrating the procedure as applied to another case. In FIGS. *6a* and *6b*, the floors marked with a star are the crowded disembarking floors as determined by the learning means 5C.

In FIG. *6a*, the 8th and the 10th floor are the crowded disembarking floors as determined by the learning means 5C. The first elevator 11 has the service schedule "2–6", which is displayed on the service schedule display board 2 thereof. The second elevator 12 has the service schedule "8–10", which is displayed on the service schedule display board 2 thereof. The third elevator 13 has no service schedule yet. Under this circumstance, it is assumed that the destination button for the 11th floor is pushed by a passenger and is registered. Then, the call allotment judgment means 5A first determines the range X of floors which are within two stories above or below the newly registered 11th floor. The range X consists of 9th through 13th floor, as indicated by the arrows at the right of FIG. *6a*. Further, the call allotment judgment means 5A judges whether or not the range X overlaps with the service schedule of any one of the cages in operation. The call allotment judgment means 5A thus determines the cages with a service schedule overlapping with the range X. In this case, the range X overlaps with the service schedule of the second elevator 12. Furthermore, the call allotment judgment means 5A judges whether or not the cages with an overlapping service schedule include crowded floors. In this case, the second elevator 12 serves the crowded floors, the 8th and the 10th floor. Thus, the call allotment judgment means 5A allots the newly registered 11th floor to the third elevator 13, which has hitherto been without a service schedule. A new service schedule, the 11th through 13th floor, is created for the third elevator 13 and is displayed on the service schedule display board 2 thereof. The new service schedule created for the third elevator 13.consists of floors situated within a predetermined number of stories above or below the newly registered floor, excepting those floors which form part of other existing service schedules.

In FIG. *6b*, on the other hand, the 6th and the 7th floor are the crowded disembarking floors as determined by the learning means 5C. The first elevator 11 has the service schedule "6–8", which is displayed on the service schedule display board 2 thereof. The second elevator 12 has the service schedule "2–5", which is displayed on the service schedule display board 2 thereof. The third elevator 13 has the service schedule "10–14", which is displayed on the service schedule display board 2 thereof. Under this circumstance, it is assumed that the destination button for the 9th floor is pushed by a passenger and is registered. Then, the call allotment judgment means 5A first determines the range X of floors which are within two stories above or below the newly registered 9th floor. The range X consists of 7th through 11th floor, as indicated by the arrows at the right of FIG. *6b*. Further, the call allotment judgment means 5A judges whether or not the range X overlaps with the service schedules of the cages in operation, and determines the cages with an overlapping service schedule. In this case, the range X overlaps with the service schedules of the first elevator 11 and the third elevator 13. Furthermore, the call allotment judgment means 5A judges whether or not the cages with an overlapping service schedule include crowded floors. In this case, the first elevator 11 serves the crowded disembarking floors, the 6th and the 7th floor. Thus, the call allotment judgment means 5A allots the newly registered 9th floor to the third elevator 13 with a service schedule which does not include crowded disembarking floors. The service schedule of the third elevator 13 is thus extend to include the newly registered 9th floor. The new service schedule, "9–14", of the third elevator 13 is displayed upon the service schedule display board 2 thereof.

Figure 7:
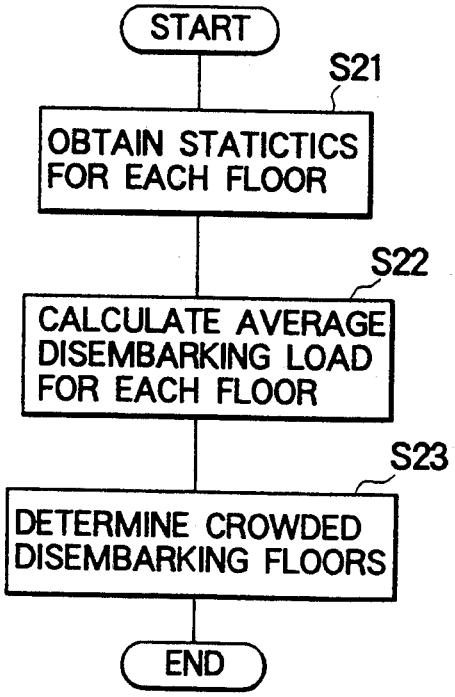
FIG. 7 is a flowchart showing the procedure by which the learning means 5C determines and registers the crowded disembarking floors.

FIG. 7 is a flowchart showing the procedure by which the learning means 5C determines and registers the crowded disembarking floors. At step S21, the learning means 5C obtains statistics of disembarking passengers for each floor. Namely, each time one of the cages stops at a floor, the disembarking load is determined. The disembarking load may be measured in terms of the percentage of disembarking passenger load with respect to the maximum load of the cage. This is determined by calculating the difference between the load of the cage before landing at the floor and the load thereof after disembarkation thereat, and then calculating the percentage of the above difference with respect to the maximum rated load of the cage. The statistics or data of the disembarking load for each floor is stored by the learning means 5C.

Next, at step S22, on the basis of the statistics obtained at step S21, the average disembarking load for each floor is calculated. The average is obtained by dividing the sum of the disembarking loads for each floor by the number of stops of a cage thereat. Further, at step S23, the crowded disembarking floors are determined. Namely, the learning means 5C compares the average disembarking load of each floor with a predetermined level, and determines the floors exceeding the predetermined level as the crowded disembarking floors. The steps S22 and S23 are executed periodically at a predetermined interval (for example, once in each week). The floors judged as the crowded disembarking floor are registered in the group controller 5.

Figure 8:
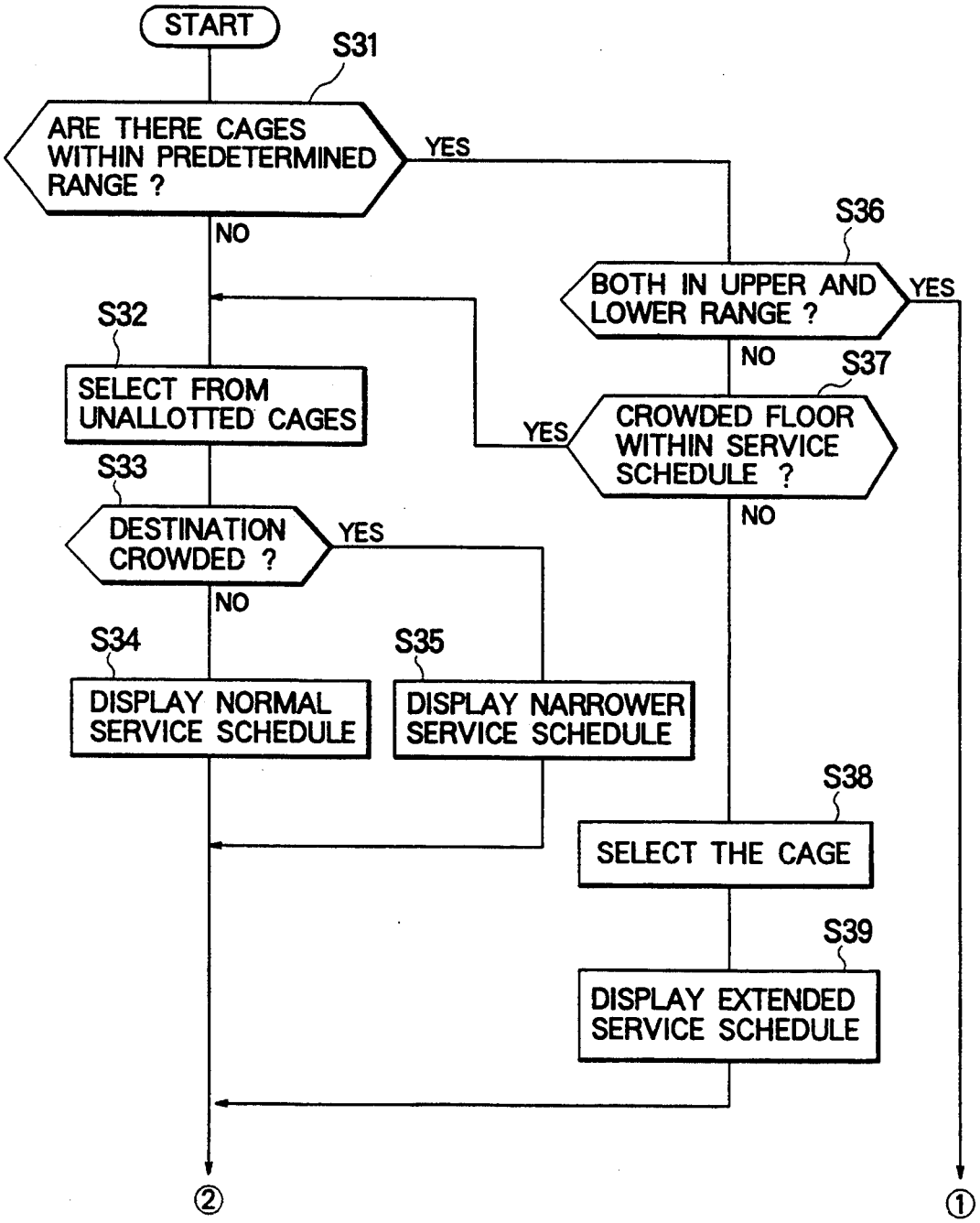
FIG. 8 shows the first half of the flowchart showing the service schedule modification and creation procedure according to the second embodiment of this invention.
Figure 9:
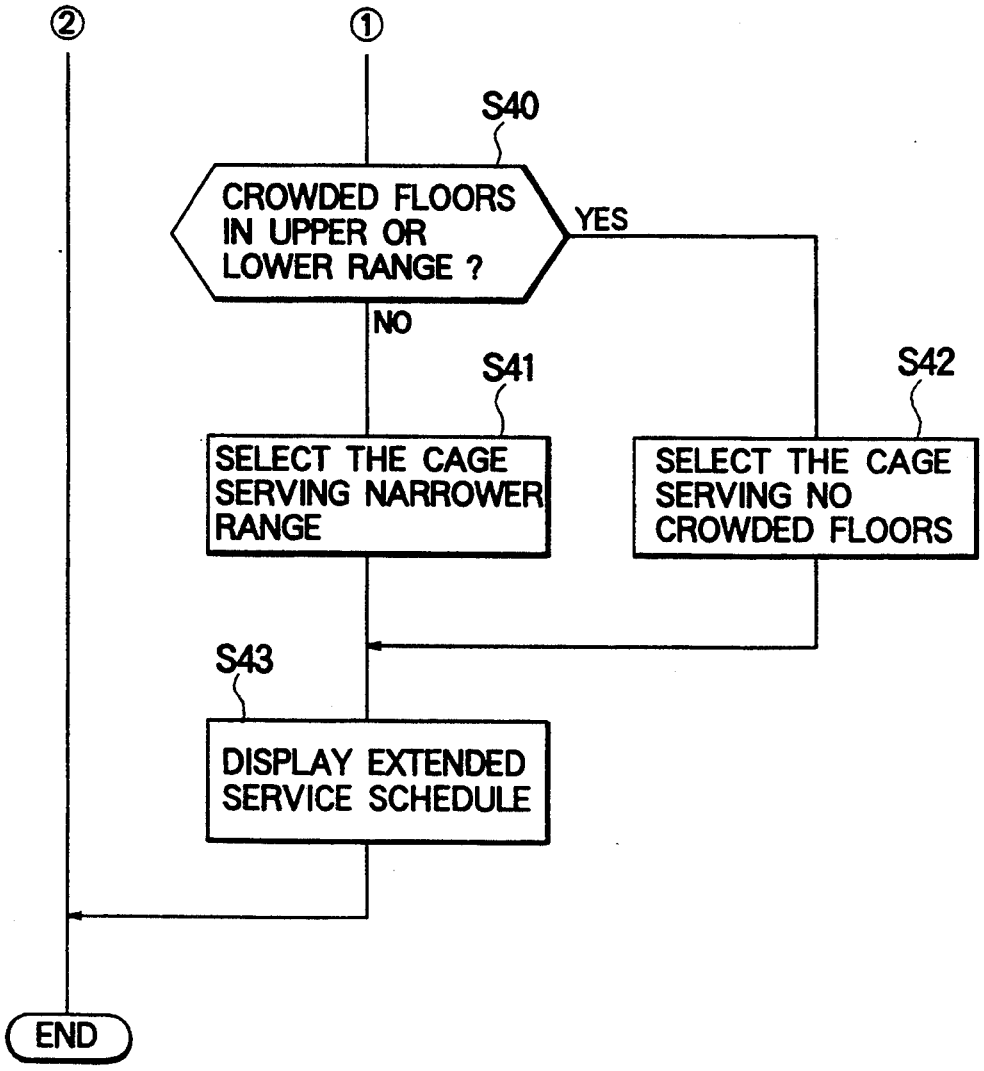
FIG. 9 shows the second half of the flowchart shown in FIG. 8.

FIG. 8 shows the first half of the flowchart showing the service schedule modification and creation procedure according to the second embodiment of this invention. FIG. 9 shows the second half of the flowchart shown in FIG. 8. The part shown in FIG. 8 is connected to that shown in FIG. 9 via the connectors represented by encircled numerals 1 and 2. When a passenger pushes a destination button upon a destination button board 1, the procedure of FIGS. 8 and 9 determines the cage which is allotted to the newly registered floor.

At step S31, it is judged whether or not there exist cages with the service schedule extending to floors within a predetermined range above or below the newly registered destination floor. Namely, the call allotment judgment means 5A first determines the range X consisting of floors within a predetermined number of stories (e.g., two stories) above or below the newly registered floor. Next, the call allotment judgment means 5A judges whether or not the range X has an overlap with any one of the service schedules of the cages in operation.

If the judgment is negative at step S31, the execution proceeds to step S32, where an unallotted cage is selected. Namely, a cage which has not been put in operation yet and hence is without any service schedule is selected. After step S32, the execution proceeds to step S33 where it is judged whether or not the newly registered floor is a crowded disembarking floor. If the judgment is negative, the execution proceeds to step S34 where a new service schedule consisting of floors within a predetermined number of stories above or below the newly registered floor is created and displayed on the service schedule display board 2 of the selected cage. Thus, the new service schedule is a normal service schedule consisting of a predetermined number of floors. On the other hand, if the judgment is positive at step S33, the execution proceeds to step S35, where a new service schedule which is narrower than the normal service schedule is created and displayed upon the service schedule display board 2 of the selected cage. In this example, the narrower service schedule is shorter than the normal service schedule by one floor both at the top and the bottom end thereof. Thus, the narrower service schedule created at step S35 is shorter than the normal service schedule created at step S34 by a total of two floors.

If the judgment is affirmative at step S31, the execution proceeds to step S36. When the execution has proceeded to step S36, it has already been determined at step S31 that the range X has an overlap with at least one of the existing service schedules. Thus at step S36, the call allotment judgment means 5A judges whether both the upper and the lower half of the range X exhibit an overlap with one of the existing service schedules. In effect, the call allotment judgment means 5A determines at step S36 whether or not there exist a plurality of cages with their respective service schedules overlapping with the range X.

If the judgment is negative at step S36, the execution proceeds to step S37, where it is judged whether or not there exist a crowded disembarking floor within the service schedule overlapping with the range X. If the judgment is affirmative at step S37, the execution proceeds to step S32, to be followed by the steps S33 through S35. On the other hand, if the judgment is negative at step S37, the execution proceeds to step S38, where the cage with the service schedule overlapping with the range X is selected and the newly registered floor is allotted to the selected cage. Further, at step S39, the service schedule of the selected cage is extended to include the newly registered floor, and the extended service schedule is displayed on the service schedule display board 2 thereof.

On the other hand, if the judgment is affirmative at step S36, the execution proceeds to step S40 where it is judged whether or not there exist a crowded disembarking floor within the upper or the lower half of the range X. In effect, it is determined whether or not there exist a crowded disembarking floor within the respective service schedules overlapping with the range X. If the judgment is negative at step S40, the execution proceeds to step S41, where the ranges of the service schedules (i.e., the numbers of floors constituting the respective service schedules) overlapping with the range X are compared, and the cage with the narrower service schedule (i.e., the service schedule consisting of the smaller number of floors) is selected, and the newly registered floor is allotted thereto. If the number of cages is more than three, there may exist more than two cages with service schedules overlapping with the range X. Then, the cage with the service schedule consisting of the smallest number of floors is selected.

On the other hand, if the judgment is affirmative at step S40, the execution proceeds to step S42, where the cage with the service schedule not including any crowded disembarking floors is selected and the newly registered floor is allotted to the selected cage. If all the service schedules overlapping with the range X include at least one crowded disembarking floor, the cage with the least disembarking load (namely, the cage for which the sum of the average disembarking loads of the floors within the service schedule thereof is the smallest) may be selected.

After the step S41 or S42, the execution proceeds to step S43, where the service schedule of the selected cage is extended to include the newly registered destination floor. The extended service schedule of the cage is immediately displayed on the service schedule display board 2 of the selected cage.

As described above, according to the procedure of FIGS. 8 and 9, the service schedules of the cages serving the crowded disembarking floors are rendered shorter than the normal, such that the passengers may be evenly distributed among the cages. Thus, the scheduling efficiency of the elevator cages is further enhanced.

The embodiments above relate to the case where only calls of the cage from the main floor are subject to the cage scheduling according to this invention. However, the principle of this invention may be applied to the calls from other floors. Furthermore, the principle of this invention may be applied to the calls during the normal hours other than the time zones crowded by commuters.

What is claimed is:

1. An elevator group control device for controlling a plurality of elevator cages installed in a building, on at least one floor of which are provided destination button means for selecting a destination floor and service schedule display means for displaying service schedules indicative of floors that can be served by respective elevator cages, said elevator group control device comprising:

destination floor registration means for registering a destination floor in response to a selection of said destination floor by a passenger by means of said destination button means;

call allotment judgment means for determining a cage allotted to a destination floor registered by said destination floor registration means, wherein:

(a) said call allotment judgment means judges whether or not there exist a cage with a service schedule extending to a floor within a predetermined range above or below said destination floor;

(b) if the judgment is affirmative at (a), said call allotment judgment means extends said service schedule of said cage to include said destination floor;

(c) if the judgment is negative at (a), said call allotment judgment means selects a cage hitherto without a service schedule and allots said destination floor to said selected cage, creating a new service schedule including said destination floor for said selected cage; and (d) said call allotment judgment means transmits information upon said service schedule of said cage to said service schedule display means such that said service schedule of said cage is displayed immediately by said service schedule display means; and means for dispatching the cage determined by said call allotment judgment means to the destination floor.

2. An elevator group control device for controlling a plurality of elevator cages installed in a building on at least one floor of which are provided destination button means for selecting a destination floor and service schedule display means for displaying service schedules indicative of floors that can be served by respective elevator cages, said elevator group control device comprising:

destination floor registration means for registering a destination floor in response to a selection of said destination floor by a passenger by means of said destination button means;

learning means for determining and registering crowded floors on the basis of periodically obtained statistics of load data of respective cages for each floor;

call allotment judgment means for determining a cage allotted to a destination floor registered by said destination floor registration means, wherein:

(a) said call allotment judgment means judges whether or not there exist a cage with a service schedule extending to a floor within a predetermined range above or below said destination floor;

(b) if the judgment is affirmative at (a), said call allotment judgment means determines whether or not said service schedule extending to a floor within said predetermined range above or below said destination includes at least one of said crowded floors;

(c) if the judgment is negative at (b), said call allotment judgment means extends said service schedule of said cage to include said destination floor;

(d) if the judgment is negative at (a), said call allotment judgment means selects a cage hitherto without a service schedule and allots said destination floor to said selected cage, creating a new service schedule including said destination floor for said selected cage, said new service schedule consisting of floors situated within a second predetermined number of stories above or below said destination floor;

(e) if the judgment is affirmative at (b), said call allotment judgement means selects a cage hitherto without a service schedule and allots said destination floor to said selected cage, creating a new service schedule including said destination floor for said selected cage, said new service schedule consisting of floors situated within a third predetermined number of stories above or below said destination floor, said third predetermined number being less than said second predetermined number; and (f) said call allotment judgment means transmits information upon said service schedule of said cage to said service schedule display means such that said service schedule of said cage is displayed immediately by said service schedule display means; and means for dispatching the cage determined by said call allotment judgment means to the destination floor.

3. An elevator group control device for controlling a plurality of elevator cages installed in a building on at least one floor of which are provided destination button means for selecting a destination floor and service schedule display means for displaying service schedules indicative of floors that can be served by respective elevator cages, said elevator group control device comprising:

destination floor registration means for registering a destination floor in response to a selection of said destination floor by a passenger by means of said destination button means; and call allotment judgment means for determining a cage allotted to a destination floor registered by said destination floor registration means, wherein:

(a) said call allotment judgment means determines whether or not there exist a cage with a service schedule including said destination floor, and if the judgment is affirmative, selects a cage with a service schedule including said destination floor and allots said destination floor to said cage;

(b) if the judgment is negative at (a) said call allotment judgment means judges whether or not there exist a cage with a service schedule extending to a floor within a predetermined range above or below said destination floor;

(c) if the judgment is affirmative at (b), said call allotment judgment means extends said service schedule of said cage to include said destination floor;

(d) if the judgment is negative at (b), said call allotment judgment means selects a cage hitherto without a service schedule and allots said destination floor to said selected cage, creating a new service schedule including said destination floor for said selected cage; and (e) said call allotment judgment means transmits information upon said service schedule of said cage to said service schedule display means such that said service schedule of said cage is displayed immediately by said service schedule display means; and means for dispatching the cage determined by said call allotment judgment means to the destination floor.

4. An elevator group control device for controlling a plurality of elevator cages installed in a building on at least one floor of which are provided destination button means for selecting a destination floor and service schedule display means for displaying service schedules indicative of floors that can be served by respective elevator cages, said elevator group control device comprising:

destination floor registration means for registering a destination floor in response to a selection of said destination floor by a passenger by means of said destination button means;

learning means for determining and registering crowded floors on the basis of periodically obtained statistics of load data of respective cages for respective cages; and call allotment judgment means for determining a cage allotted to a destination floor registered by said destination floor registration means, wherein:

(a) said call allotment judgment means determines whether or not there exist a cage with a service schedule including said destination floor, and if the judgment is affirmative, selects a cage with a service schedule including said destination floor and allots said destination floor to said cage;

(b) if the judgment is negative at (a) said call allotment judgment means judges whether or not there exist a cage with a service schedule extending to a floor within a predetermined range above or below said destination floor;

(c) if the judgment is affirmative at (b), said call allotment judgment determines whether or not said service schedule extending to a floor within said predetermined range above or below said destination includes at least one of said crowded floors;

(d) if the judgment is negative at (c), said call allotment judgment means extends said service schedule of said cage to include said destination floor;

(e) if the judgment is negative at (b), said call allotment judgment means selects a cage hitherto without a service schedule and allots said destination floor to said selected cage, creating a new service schedule including said destination floor for said selected cage, said new service schedule consisting of floors situated within a second predetermined number of stories above or below said destination floor;

(f) if the judgment is affirmative at (c), said call allotment judgment means selects a cage hitherto without a service schedule and allots said destination floor to said selected cage, creating a new service schedule including said destination floor for said selected cage, said new service schedule consisting of floors situated within a third predetermined number of stories above or below said destination floor, said third predetermined number being less than said second predetermined number; and (g) said call allotment judgment means transmits information upon said service schedule of said cage to said service schedule display means such that said service schedule of said cage is displayed immediately by said service schedule display means; and means for dispatching the cage determined by said call allotment judgment means to the destination floor.

* * * * *